United States Patent [19]

Hollars

[11] 3,945,055

[45] Mar. 23, 1976

[54] TOILET FLUSHING RESERVOIR SYSTEM

[75] Inventor: Bennie L. Hollars, Orangevale, Calif.

[73] Assignee: Arnold E. Hollars, Orangevale, Calif. ; a part interest

[22] Filed: Oct. 5, 1973

[21] Appl. No.: 404,047

[52] U.S. Cl. ..... 4/30; 4/31; 4/67 R

[51] Int. Cl.[2] ..... E03D 3/04

[58] Field of Search ..... 4/18, 20, 26, 27, 28, 30, 4/31, 35, 37–41, 52, 67 R, 67 A, 249, 29, 56, 65; 251/25, 28, 29; 137/262, 576, 587

[56] References Cited

UNITED STATES PATENTS

| | | | |
|---|---|---|---|
| 2,177,099 | 10/1939 | Dreyer et al. | 251/25 X |
| 2,285,073 | 6/1942 | Zimmerman | 4/26 |
| 2,957,181 | 10/1960 | Lamping | 4/26 |
| 2,979,732 | 4/1961 | Harrow | 4/26 |
| 3,060,450 | 10/1962 | Rupert | 4/30 |
| 3,397,408 | 8/1968 | Skousgaard | 4/26 |
| 3,566,416 | 3/1971 | Altieri et al. | 4/40 |
| 3,789,432 | 2/1974 | Pozzi | 4/26 |
| 3,790,967 | 2/1974 | Pignato | 4/28 |

*Primary Examiner*—Richard E. Aegerter
*Assistant Examiner*—Stuart S. Levy
*Attorney, Agent, or Firm*—Irvin A. Lavine

[57] ABSTRACT

A toilet flushing reservoir system is provided which includes a reservoir comprising upper and lower headers and individual longitudinally extending pipes between the headers: one of the pipes has a flow restrictor therein. The top header is provided with a water inlet and a vent, controlled by a float valve. A discharge valve in the lower head is opened by a hydraulic motor, under the control of a manual flushing control valve. The headers are of synthetic resin and are substantially identical.

9 Claims, 6 Drawing Figures

TOILET FLUSHING RESERVOIR SYSTEM

BACKGROUND OF THE INVENTION

The present invention pertains to a toilet flushing reservoir system, and in particular to a reservoir therefor.

The most widely used toilet flushing systems include a reservoir or tank which is connected to a water main through a water line, the admission of water into the tank being controlled by a valve, which valve is operated by a float carried by an arm extending from the inlet valve. The flow of water from the tank, into the toilet bowl, is controlled by a ball valve, which is usually of soft material, being pressed into engagement with the valve seat by the head of water in the tank, the ball valve being lifted from its seat by a suitable mechanism, such as a lever. Such apparatus is known to suffer from a number of deficiencies, including the taking up of a significant amount of floor space by the tank, as well as the unsightliness of the tank and associated plumbing. The soft ball valve will deteriorate after a period of use, and such tanks have generally been found to be expensive in that they require a substantial amount of machining of the parts, particularly the inlet valve, as well as requiring expensive casting operations. In addition, rather complex and expensive assembly operations are required. Further, the known, above described systems are prone to leaking, and the tanks themselves are heavy, usually being made of cast ceramic, and are therefore expensive to ship from the place of manufacture to the place of use.

There have also been proposed other toilet flushing reservoirs, some of which have involved generally linerally extending pipes or tanks, which were placed within a wall. These reservoirs have generally operated on the principle of an air cushion, trapped at the top of the body of water within the pipe, or pipes, or tank. This trapped air was compressed when the water flowed into the reservoir, from the bottom, and when the outlet valve was operated, the trapped air expanded, to assist in forcing the water into the toilet bowl, this assistance being in addition to the gravity-caused water flow. The trapped-air or air cushion type of reservoir has not met with wide spread usage, because of a fundamental deficiency. That is, the trapped air over a period of time becomes entrained in or absorbed by the water, particularly since there are sequential bodies of water with which the air comes in contact. The absorption or entrainment of the air ultimately diminishes the amount of air in the air cushion above the body of water, so that the available force is gradually diminished, until, ultimately, the amount of air remaining is so small as to be unsatisfactory in providing the volume and velocity of water flow from the reservoir.

Recognizing the deficiencies of the air cushion type of reservoir, a proposal has been made to substitute a spring device for the air cushion, but such a spring device cannot be economically made, is liable to breakage after an extended period of use, and must be expensively made in order to be long lasting.

A still further proposal of the prior art provided an upper tank into which water was admitted, the tank having an outlet valve operated by a lever, the tank discharging into a lower tank, into which pipes with lateral openings extended, which pipes communicated with the toilet bowl. This apparatus required a dash pot for satisfactory operation, which dash pot is liable to become ineffective after a period of use. Further, such a construction provided an undesirable three stage flushing operation including a slow first stage, a fast second stage and a slow third stage.

SUMMARY OF THE INVENTION

The present invention provides a toilet flushing reservoir system including a reservoir comprising upper and lower headers which are mechanically and fluid connected by parallel, longitudinally extending pipes or conduits. The headers are substantially identical in form, and are made of synthetic plastic, while the pipes are also of synthetic plastic, and may be made by conventional, economical extrusion methods. The upper header is provided with an inlet, for connection to a water line, leading to a water main, and is also provided with a vent outlet, controlled by a float valve. The outlet is in axial alignment with one of the pipes, and a detent in the pipe limits downward movement of the float valve. A flow restrictor is provided in one of the pipes, so as to provide a trickle flow subsequent to the main high volume and high velocity flow. The bottom header has an outlet connected to a conduit, in which is a manually operated valve, the conduit leading to a hydraulic motor which operates an outlet valve normally seated in the lower header. The two headers and connecting pipes are preferably positioned within a wall, so as to be removed from sight. Due to the construction, of synthetic resin, the herein provided reservoir provides a substantial reduction in noise.

Among the objects of the present invention are to provide a toilet flushing reservoir system which can be positioned so as to not use floor space, and to provide such a system which will be quiet, and not unsightly.

Another object of the present invention is the provision of a toilet flushing reservoir system having greatly reduced metal to metal contact, and to therefore provide such a system capable of long use without requiring repair or replacement of the parts thereof.

A still further object of the present invention is to provide a reservoir system capable of placing the outlet valve under a high head of water, to thereby permit utilization of a longer lasting outlet valve.

A further object of the present invention is the provision of a toilet flushing reservoir system which is inexpensive, and utilizes standard synthetic resin molded products, which can be quickly made and readily assembled, and which is not prone to leaks.

Yet another object of the present invention is to provide a toilet flushing reservoir system which is light in weight, economical to ship, and easy to handle.

A still further object of the present invention is the provision of such a reservoir and system which does not rely upon an air cushion for operation, and will thereby be useful over a relatively long period of time, without repair or replacement.

A still further object of the present invention is to provide a toilet flushing reservoir system which will enable flushing with a strong first stage and a trickle second stage of water flow.

Other objects and many of the attendant advantages of the present invention will be readily understood from consideration of the following specification, claims and drawings.

DESCRIPTION OF THE PREFERRED EMBODIMENT

Figure 1:
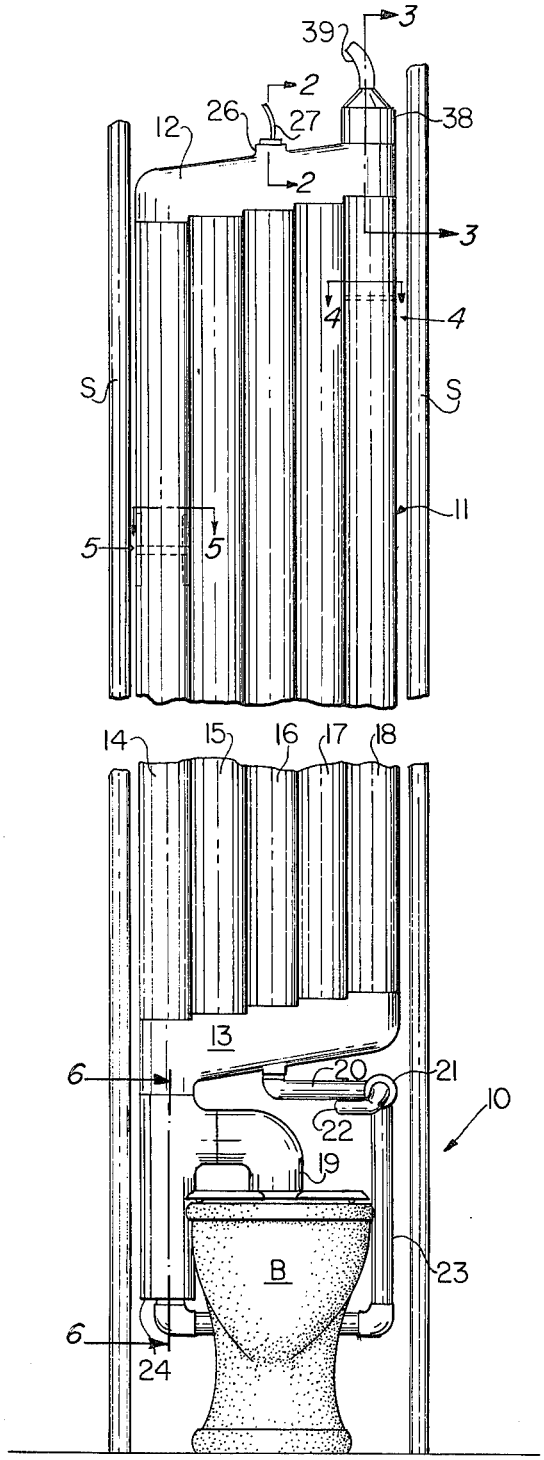
FIG. 1 is an elevational view of a toilet flushing reservoir system in accordance with the present invention.

Referring now to the drawings, wherein like or corresponding reference numerals are used for like or corresponding parts throughout the several views, there is shown in FIG. 1 a toilet flushing reservoir system 10 in accordance with the present invention. The system 10 includes a reservoir 11 comprising an upper tank-like header 12, a lower tank-like header 13, and a plurality of pipes 14, 15, 16, 17 and 18 extending between and connected to the headers 12 and 13. The headers 12 and 13 are substantially identical in construction, with plural openings in one wall, and are preferably made of synthetic resin material, so that they can be manufactured by standard molding or other synthetic resin techniques. Similarly, the pipes 14–18 are of synthetic resin, and may be manufactured by conventional resin or plastic extrusion processes, and are therefore light weight, economical and resistant to noise transmission. The reservoir 11 is connected with a conventional toilet bowl B by an L-shaped conduit 19.

A conduit 20 is connected with the lower header 13, at a central portion thereof, and is connected in conventional manner to a valve 21, which may be opened by operation of the valve handle 22. Also connected to the valve 21 is a conduit 23 which extends to a hydraulic motor 24 that is connected to the left side (as viewed in FIG. 1) of lower header 13.

The reservoir 11 is of relatively small thickness, preferably being less than about three and one-half inches, so that it may be positioned within a wall. To this end, there are shown in FIG. 1 a pair of conventional studs S, the reservoir 11 being shown placed between the studs S. As will be understood, a suitable material, such as wall board, may be placed across the studs S, in conventional manner, thereby concealing from view the reservoir 11.

Figure 2:
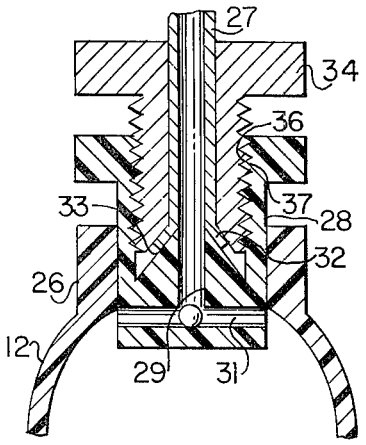
FIG. 2 is a cross sectional view taken on the line 2—2 of FIG. 1.

Extending upwardly from the upper header 12 is a boss 26, and an unvalved, constantly open water inlet conduit 27 may be seen extending thereto. As shown in FIG. 2, the boss 26 is hollow, and receives a plastic coupling member 28, having a vertical passage 29 and plural horizontal passages 31 therein, the latter discharging into the upper header 12. The water inlet line 27 is of conical shape at its lower end 32, and engages a similar conically shaped boss 33 forming a part of the coupling member 28. A further connector 34 is shown, having exterior screw threads 36 which engage with interior screw threads 37 of the coupling member 28. This construction provides for a secure connection between the header 12 and the water inlet line 27, and also provides for distribution of water into the header 12 through the several passages 31 so as to provide for relatively silent flow of the water into the upper header 12.

Referring again to FIG. 1, in line with the pipe 18 there may be seen a second boss 38, and a vent pipe 39.

Figure 3:
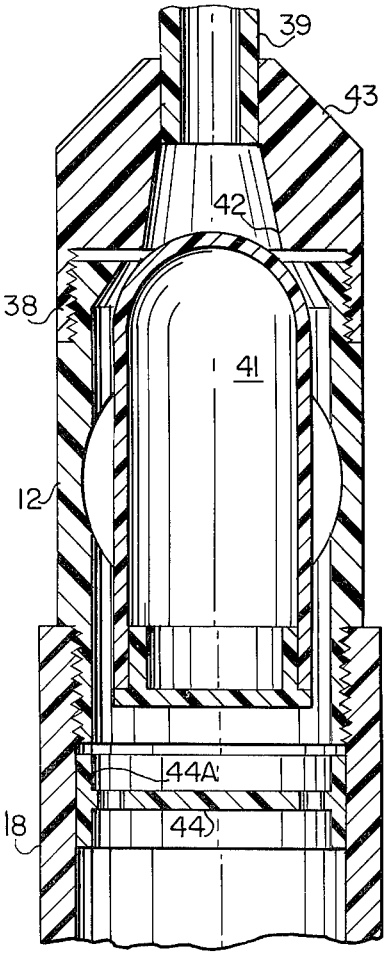
FIG. 3 is a cross sectional view taken on the line 3—3 of FIG. 1.

As shown in FIG. 3, within the hollow boss 38 is a float valve 41, which is preferably made of synthetic resin, and which engages a valve seat 42 formed in a valve seat and connector member 43, to which the vent pipe 39 is joined. The connector 43 may be screwed to the boss 38, and the vent pipe 39 may be secured by adhesive, solvent, or the like to the connector 43. The boss 38 forms a part of the upper header 12, and the pipe 18 may be seen joined to the header 12, having a plate 44 therein, positioned below float valve 41. The plate 44 is apertured, and offers substantially no impediment to the flow of water into and through the pipe 18.

Figure 4:
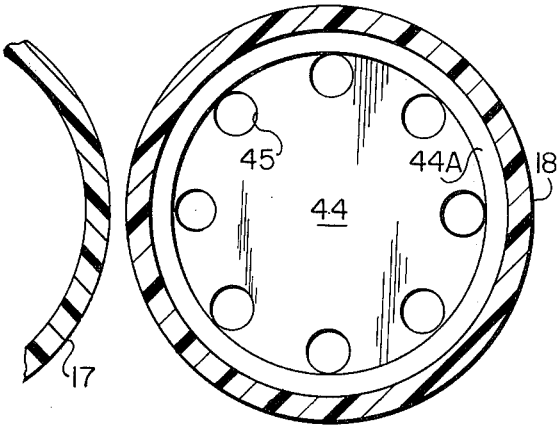
FIG. 4 is a cross sectional view taken on the line 4—4 of FIG. 1.
Figure 5:
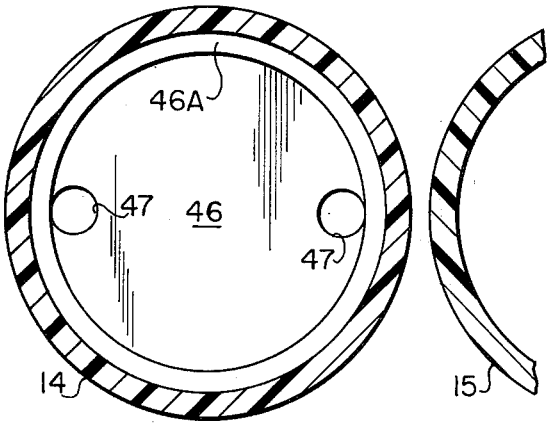
FIG. 5 is a cross sectional view taken on the line 5—5 of FIG. 1.

Referring to FIG. 4, there may be seen the pipe 18, and the plate 44, with a multiplicity of apertures 45 therein. The configuration of plate 44 shown in FIG. 4 is illustrative only, as will be readily understood. Referring now to FIG. 5, there may be seen the pipe 14, and a portion of the adjacent pipe 15. Within the pipe 14 is a flow restrictor plate 46 having several apertures 47 therein, there being a limited number of apertures provided, so that there is some restriction of the flow of water from the upper part of pipe 14. This provides the second stage, trickle flow of water into the toilet bowl B.

Referring again to FIG. 3, the plate 44 may be part of a short cylindrical member **44*a*, adhered or otherwise secured within the pipe 18. A similar short cylindrical member 46*a* may be used to secure the restrictor 46** in position.

Figure 6:
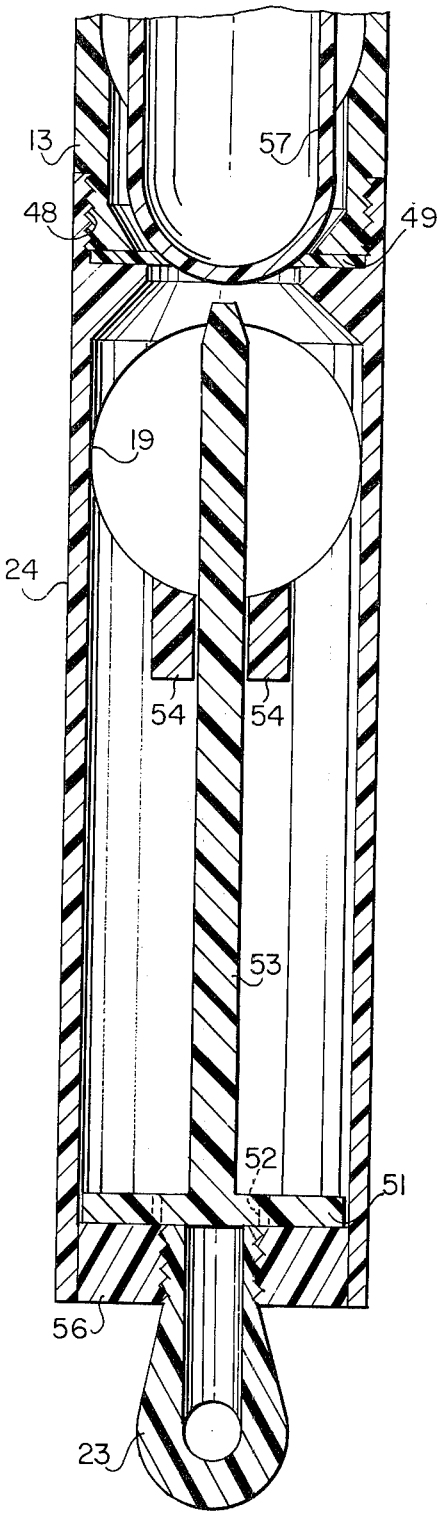
FIG. 6 is a cross sectional view taken on the line 6—6 of FIG. 1.

Referring now to FIG. 6, there may be seen therein the hydraulic motor 24, threadedly connected at its upper end to the threaded extension 48 of the lower header 13. The extension 48 is provided at its lower end with a plate 49 which forms a valve seat. Plate 49 is held in position upon the assemblage of the upper threaded end of the hydraulic motor 24 to the lower threaded extension of the lower header 13. Within the motor 24 is a piston 51 having apertures 52 therethrough, and comprising a piston rod 53, extending upwardly. Suitable guides 54 may be provided, to guide the movement of piston 51 and piston rod 53. Extending from the motor 24, there may be seen the outlet 19, adjacent the valve seat 49. The conduit 23, leading from the valve 21, is connected to an end plate 56 of the motor 24.

In axial alignment with the piston rod 53 is an outlet valve 57, which is shown seated on the valve seat 49.

In operation, the reservoir 11 is filled with water, the valve 21 is closed, and the valve 57 is seated on valve seat 49, with the piston 51 being in the position shown in FIG. 6. Also, the float valve 41 is in engagement with the seat 42. When the handle 22 is moved, valve 21 will be opened, thereby causing a greater pressure on the lower surface of the piston 51 than on the upper surface thereof, since the full head of water in the reservoir 11 will be applied to the lower surface of piston 51. This will cause piston 51 to rise, thereby unseating the outlet valve 57, and causing water to drain from the reservoir 11, and to pass into the conduit 19, and thence into the toilet bowl B. As the level of water in reservoir 11 begins to fall, the float valve 41 will descend, admitting air through the vent pipe 39 into the reservoir 11. There will be a rapid discharge of most of the water from the reservoir 11, into the toilet bowl B, with a minor fraction of the volume of water in reservoir 11 trickling thereinto in a second, subsequent water discharge phase. This is due to the restrictor 46, which will restrict the amount and velocity of flow of water in the pipe 14 thereabove.

The handle 22 may be released relatively promptly, after flushing has begun, or a slow closure of the valve 21 may be provided. In either event, when the valve 21 closes, there will be a reduction in pressure on the under side of the piston 51, and the piston 51, not being buoyant, will gradually return to its lower position, shown in FIG. 6, thereby also permitting the outlet valve 57 to close. The movement of the piston 51 is retarded, due to the size of the openings 52 therethrough.

As soon as the vent valve 41 is opened, and as soon as the water level in the reservoir 11 begins to fall, more water will be admitted through the inlet line 27; this will be at a relatively slow rate, compared to the outflow of water through the conduit 19. When the outlet valve 57 has again seated, the reservoir 11 will continue to fill, and the filling operation will continue until the float valve 41, which has been seated on the plate 44, returns to the position shown in FIG. 3, wherein it closes the vent, and when this occurs, there will be prevented any additional flow of water into the reservoir 11 since all three outlets from reservoir 11 will then be closed.

There has been provided an improved toilet flushing reservoir system comprising a reservoir which is of synthetic plastic or resin material, economically and readily fabricated, of light weight and of noise diminishing properties. The outlet valve is seated under a relatively large head of pressure, and therefore may be made of relatively hard material, so as to be long lasting. Similarly, the float valve herein provided may be of the same material and construction as the outlet valve, except for its floating characteristics, so as to also be long lasting. The entire reservoir herein disclosed may be positioned within a wall, so as to provide an improved appearance of the toilet flushing reservoir system. As will be readily understood, no floor space is taken up by the reservoir, and there will be no deterioration in effectiveness of the reservoir herein disclosed, as in systems employing an air cushion.

It will be obvious to those skilled in the art that various changes may be made without departing from the spirit of the invention, and therefore the invention is not limited to what is shown in the drawings and described in the specification but only as indicated in the appended claims.

I claim:

1. In a toilet flushing reservoir system for use with a toilet bowl and a water inlet conduit, a water reservoir including an upper tank-like header, a lower tank-like header, and a plurality of parallel, hollow, tubular members extending between said headers and providing fluid communication between the tank-like headers, said upper header comprising inlet means for connecting said upper header to said water inlet conduit, a vent for connection to atmosphere, and a float valve for controlling said vent, said lower header comprising outlet means for connection to said inlet toilet bowl, and a second outlet, control valve means for said outlet means, and manually operable means connected with said second outlet for opening the outlet control valve means.

2. The apparatus of claim 1 wherein said upper and lower headers are substantially identical.

3. The apparatus of claim 1, wherein at least one of said tubular members comprises flow restricting means, and at least one of said tubular members comprises means for permitting substantially unobstructed flow of water therethrough.

4. The apparatus of claim 1, said manually operable means comprising a hydraulic motor including a piston, a piston rod carried by said piston for opening said outlet control valve means, and manually operable valve means fluid connected to said hydraulic motor and said second outlet for selectively permitting passage of water from said lower header to said hydraulic motor.

5. The apparatus of claim 1, wherein said tubular members are in side by side relationship, with their axes substantially coplanar.

6. The apparatus of claim 5, said tubular members being closely spaced.

7. The apparatus of claim 1, wherein the vent of the upper header is at one end thereof and the outlet means of the lower header is at one end thereof, said vent and outlet having their axes spaced from each other.

8. The apparatus of claim 1, wherein the vent of the upper header is in line with a said tubular member, which said tubular member has means therein for limiting movement of said float valve away from said vent and for permitting water to flow through said limiting means in a substantially unobstructed manner.

9. The apparatus of claim 1, wherein said headers and tubular members are of synthetic resin.

* * * * *